US010641588B2

(12) United States Patent
Collier

(10) Patent No.: US 10,641,588 B2
(45) Date of Patent: May 5, 2020

(54) SIMULTANEOUS LINEAR INITIATION MECHANISM

(71) Applicant: Nicholas Collier, Smithville, TX (US)

(72) Inventor: Nicholas Collier, Smithville, TX (US)

( * ) Notice: Subject to any disclaimer, the term of this patent is extended or adjusted under 35 U.S.C. 154(b) by 13 days.

(21) Appl. No.: 16/103,746

(22) Filed: Aug. 14, 2018

(65) Prior Publication Data

US 2018/0372462 A1 Dec. 27, 2018

Related U.S. Application Data

(63) Continuation-in-part of application No. 15/910,885, filed on Mar. 2, 2018, now Pat. No. 10,458,761.

(60) Provisional application No. 62/466,296, filed on Mar. 2, 2017.

(51) Int. Cl.

| | |
|---|---|
| ***F42B 3/26*** | (2006.01) |
| ***F42B 1/028*** | (2006.01) |
| ***F42C 19/08*** | (2006.01) |
| ***E21B 43/117*** | (2006.01) |

(52) U.S. Cl.

CPC ..... *F42B 3/26* (2013.01); *E21B 43/117* (2013.01); *F42B 1/028* (2013.01); *F42C 19/0807* (2013.01); *F42C 19/0846* (2013.01)

(58) Field of Classification Search

CPC .... F42B 3/26; F42B 1/028; F42B 1/00; F42B 1/02; F42B 1/024; F42B 1/038; F42B 1/032; F42B 1/036; E21B 43/117; F42C 19/0807; F42C 19/0846

USPC ..... 102/476

See application file for complete search history.

(56) References Cited

U.S. PATENT DOCUMENTS

| | | | | |
|---|---|---|---|---|
| 3,443,518 A * | 5/1969 | Cross | F42B 1/02 | 102/306 |
| 3,477,372 A * | 11/1969 | Nelson | F24B 1/028 | 102/307 |
| H001216 H * | 8/1993 | Vigil | 102/306 | |
| 5,479,860 A * | 1/1996 | Ellis | E21B 43/1185 | 102/202.7 |
| 5,792,977 A * | 8/1998 | Chawla | F42B 1/032 | 102/307 |
| 8,006,621 B1 * | 8/2011 | Cherry | B26F 3/04 | 102/307 |
| 2005/0115391 A1 * | 6/2005 | Baker | F42B 1/02 | 89/1.151 |
| 2006/0201373 A1 * | 9/2006 | Sammons | F42B 3/08 | 102/476 |

(Continued)

*Primary Examiner* — Joshua E Freeman
*Assistant Examiner* — Bridget A Cochran
(74) *Attorney, Agent, or Firm* — Derek R. Van Gilder

(57) ABSTRACT

A simultaneous linear initiation mechanism (SLIM). The SLIM includes a first layer. The first layer includes a port, where the port passes through the first layer and is configured to receive a first high explosive. The SLIM also includes a second layer. The second layer includes one or more traces, where the one or more traces include channels within the second layer configured to receive a second high explosive and two or more destination points, where the two or more destination points are the terminal ends of the one or more traces. The SLIM further includes one or more saddle blocks. The one or more saddle blocks include one or more traces, where the one or more traces include channels within the saddle block configured to receive a third high explosive and multiple outlets, where the multiple outlets are configured to receive the third high explosive.

20 Claims, 3 Drawing Sheets

(56) References Cited

U.S. PATENT DOCUMENTS

2007/0051234 A1* 3/2007 Sansolo ..... F42D 3/00
89/1.14
2009/0255433 A1* 10/2009 Wang ..... F42B 1/028
102/307

* cited by examiner

SIMULTANEOUS LINEAR INITIATION MECHANISM

CROSS-REFERENCE TO RELATED APPLICATIONS

This application is a continuation-in-part of, and claims the benefit of and priority to, U.S. Non-Provisional Patent Application Ser. No. 15/910,885 filed on Mar. 2, 2018, which application is incorporated herein by reference in its entirety.

application Ser. No. 15/910,885 claims the benefit of and priority to U.S. Provisional Patent Application Ser. No. 62/466,296 filed on Mar. 2, 2017, which application is incorporated herein by reference in its entirety.

BACKGROUND OF THE INVENTION

Existing linear shaped charges are not known for their great performance, primarily because of the lack of a linear initiation system and the lack of radial convergence of the liner. Today's technology offers only single point or multi-point initiation and a two-dimensional collapse of the liner, which causes the resulting explosively formed projectile (EFP) to be scattered, have a jagged leading edge, low velocity and poor performance, for the amount of energetics and liner material used.

Accordingly, there is a need in the art for an initiation mechanism that can be linear and simultaneous.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a simultaneous linear initiation mechanism. The simultaneous linear initiation mechanism includes a first layer. The first layer includes a port, where the port passes through the first layer and is configured to receive a first high explosive. The first layer is composed of a first low sound speed material. The simultaneous linear initiation mechanism also includes a second layer. The second layer includes one or more traces, where the one or more traces include channels within the second layer configured to receive a second high explosive and two or more destination points, where the two or more destination points are the terminal ends of the one or more traces. The second layer is composed of a second low sound speed material. A portion of each of the one or more traces in the second layer is adjacent the port in the first layer. The simultaneous linear initiation mechanism further includes one or more saddle blocks. The one or more saddle blocks include one or more traces, where the one or more traces include channels within the saddle block configured to receive a third high explosive and multiple outlets, where the multiple outlets are configured to receive the third high explosive. The one or more saddle blocks are each configured to spread the detonation wave into a simultaneous shaped stimulation on the main high explosive surface and composed of a third low sound speed material. Each destination point in the second layer is adjacent a portion of one of the one or more traces in the saddle block. The multiple outlets are configured to be placed adjacent a main high explosive.

Another example embodiment includes a simultaneous linear initiation mechanism. The simultaneous linear initiation mechanism includes a first layer. The first layer includes a port, where the port passes through the first layer and is configured to receive a first high explosive. The first layer is composed of a first low sound speed material. The simultaneous linear initiation mechanism also includes a second layer. The second layer includes one or more traces, where the one or more traces include channels within the second layer configured to receive a second high explosive and two or more destination points, where the two or more destination points are the terminal ends of the one or more traces. The second layer is composed of a second low sound speed material. A portion of each of the one or more traces in the second layer is adjacent the port in the first layer. The simultaneous linear initiation mechanism further includes a third layer. The third layer includes two or more ports configured to receive a third high explosive and is composed of a third low sound speed material. Each port in the third layer is adjacent at least one of the destination points in the second layer. The simultaneous linear initiation mechanism additionally includes one or more saddle blocks. The one or more saddle blocks include one or more traces, where the one or more traces include channels within the saddle block configured to receive a fourth high explosive and multiple outlets, where the multiple outlets are configured to receive the fourth high explosive. The one or more saddle blocks are each configured to spread the detonation wave into a simultaneous wide line of stimulation on the main high explosive surface and composed of a fourth low sound speed material. Each port in the third layer is adjacent a portion of one of the one or more traces in the saddle block. The multiple outlets are configured to be placed adjacent a main high explosive.

Another example embodiment includes a simultaneous linear initiation mechanism. The simultaneous linear initiation mechanism includes a first layer. The first layer includes a port, where the port passes through the first layer and is filled with a first high explosive. The first layer is composed of a first low sound speed material. The simultaneous linear initiation mechanism also includes a second layer. The second layer includes one or more traces, where the one or more traces include channels within the second layer filled with a second high explosive and two or more destination points, where the two or more destination points are the terminal ends of the one or more traces. The second layer is composed of a second low sound speed material. A portion of each of the one or more traces in the second layer is adjacent the port in the first layer. The simultaneous linear initiation mechanism further includes a third layer. The third layer includes two or more ports filled with a third high explosive and is composed of a third low sound speed material. Each port in the third layer is adjacent at least one of the destination points in the second layer. The simultaneous linear initiation mechanism additionally includes one or more saddle blocks. The one or more saddle blocks include one or more traces, where the one or more traces include channels within the saddle block filled with a fourth high explosive and multiple outlets, where the multiple outlets are filled with the fourth high explosive. The one or more saddle blocks are each configured to spread the detonation wave into a simultaneous wide line of stimulation on the main high explosive surface and composed of a fourth low sound speed material. Each port in the third layer is adjacent a portion of one of the one or more traces in the saddle block. The multiple outlets are configured to be placed adjacent a main high explosive. The simultaneous linear initiation mechanism moreover includes a linear liner.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
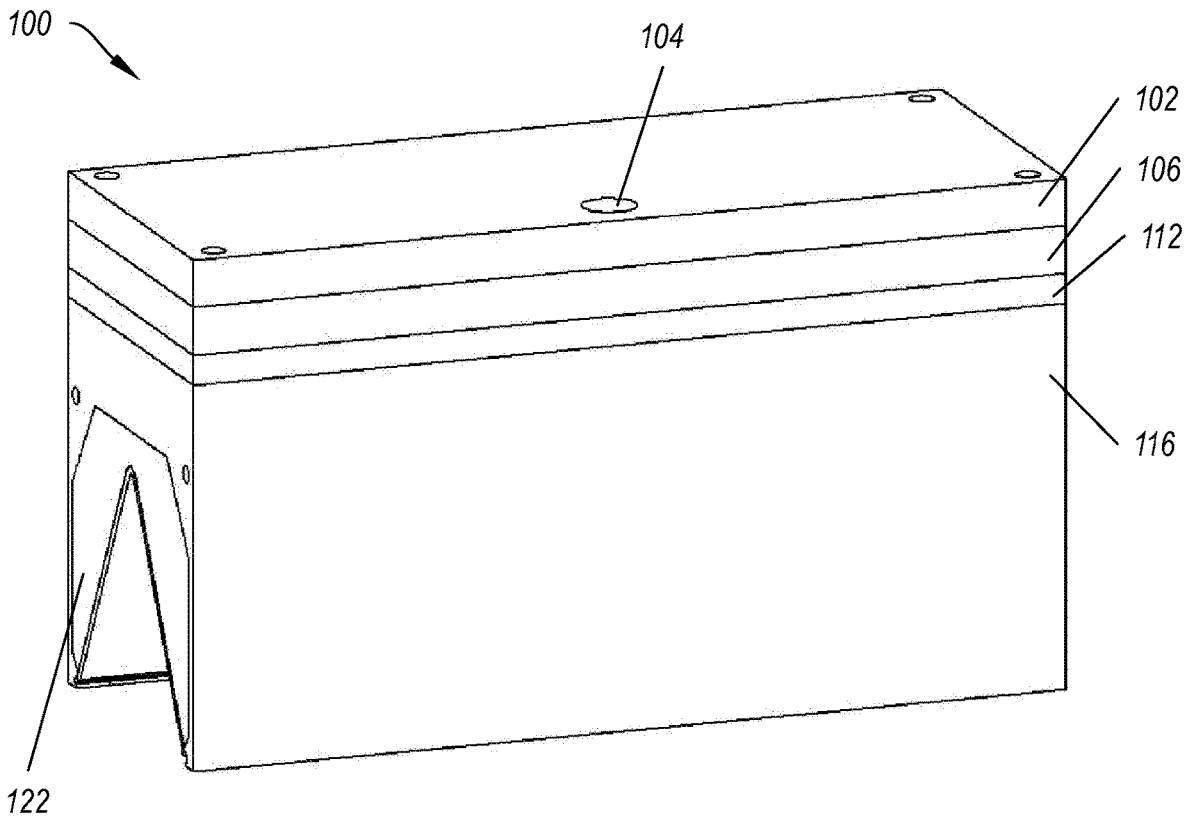
FIG. 1A is an assembled view of the example of the simultaneous linear initiation mechanism.
Figure 1B:
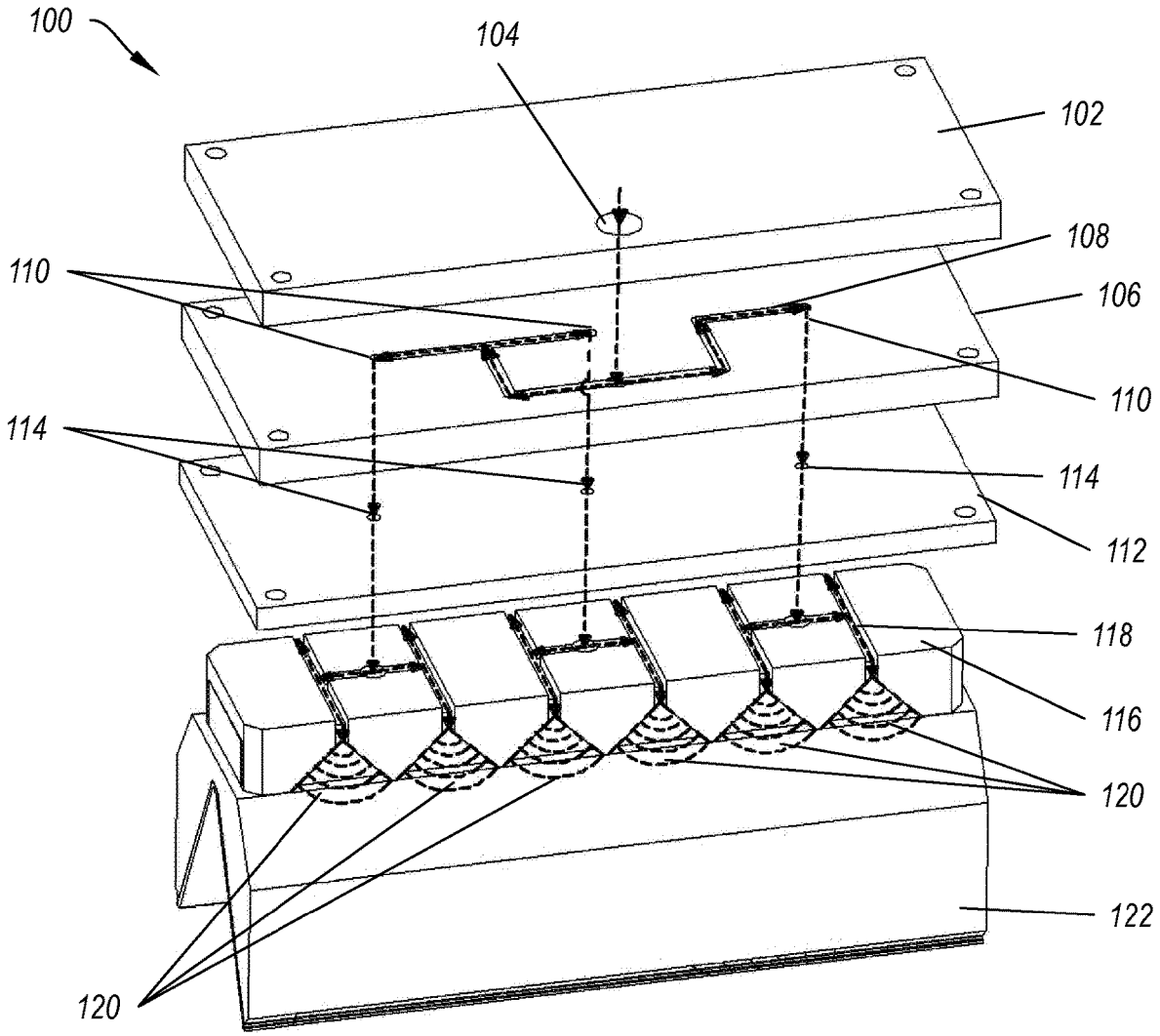
FIG. 1B is an exploded view of the example of the simultaneous linear initiation mechanism.

FIGS. 1A and 1B (collectively "FIG. 1") illustrate an example of a simultaneous linear initiation mechanism 100. FIG. 1A is an assembled view of the example of the simultaneous linear initiation mechanism 100; and FIG. 1B is an exploded view of the example of the simultaneous linear initiation mechanism 100. Using the simultaneous linear initiation mechanism 100 with a fluted linear liner (as disclosed in application Ser. No. 15/910,885 referenced previously), high jet velocities and deeper penetration will be achieved. The application of the simultaneous linear initiation mechanism 100 will even improve the performance of the standard linear liner because all parts of the standard linear liner will be collapsed simultaneously from apex to base forming a directionally controllable high performance stable sheet of material as wide as the linear length of the liner. The layering method and use of low sound speed materials facilitates the low profile of the simultaneous linear initiation mechanism system making for a more compact charge. This same concept can and will be used for other shapes and devices.

The simultaneous linear initiation mechanism 100 facilitates initiation of high explosive in a linear fashion. I.e., from a single point of initiation, a line or multiple lines of initiation, having simultaneous stimulation over the full length of the lines, can be accomplished. Therefore, multiple linear (or other shaped) charges are initiated concurrently allowing for a high degree of shaping. For example, linear shaped charges are used for cutting long slots in metals, concrete, rock or any material. There are many uses for this invention in military, oil field and mining, etc. The lines of simultaneous initiation can be straight, spline configuration, window frame or round shape.

FIG. 1 shows that the simultaneous linear initiation mechanism 100 can include a first layer 102. The first layer 102 is where the detonation begins. I.e., the first layer 102 begins an explosive chain reaction which ends with a shaped detonation. The explosion can be initiated using conventional detonators of any desired type. The first layer is composed of a low sound speed material (where low sound speed material is defined as a material having a sound speed below 1000 m/s and a very low sound speed material is defined as a material having a sound speed below 50 m/s). Examples of a low sound speed material include high density foam. High density foam as used herein includes foam that has a density of at least five pounds per cubic foot. I.e., it can include expanded polystyrene (EPS) foam that has a density greater than or equal to five pounds per cubic foot.

FIG. 1 also shows that the simultaneous linear initiation mechanism 100 includes a port 104 in the first layer 102. The port 104 is a hole which passes through the first layer 102 and is configured to be filled with high explosive material. High explosives are explosive materials that detonate, meaning that the explosive shock front passes through the material at a supersonic speed. High explosives detonate with explosive velocity ranging from 3 to 9 km/s. For instance, TNT has a detonation (burn) rate of approximately 5.8 km/s (19,000 feet per second), Detonating cord of 6.7 km/s (22,000 feet per second), and C-4 about 8.5 km/s (29,000 feet per second). The term high explosive is in contrast with the term low explosive, which explodes (deflagrates) at a lower rate. Thus, the port 104 is configured to allow the detonation of the high explosive to pass entirely through the first layer 102.

As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

FIG. 1 further shows that the simultaneous linear initiation mechanism 100 can include a second layer 106. The second layer 106 is placed adjacent the first layer 102. That is, portions of the second layer 106 are in contact with the first layer 102. In particular, the port 104 is placed adjacent the second layer 106 such that the detonation of the high explosive in the port is transmitted directly to the second layer 106. The second layer 106 is composed of a low sound speed material (which may be the same material as the first layer or a different material depending on the application). A low sound speed material contains the explosive and ensures that the detonation traverses the desired path (i.e., they are destroyed at a lower speed than the explosion propagates, acting as a path for the explosion). As used herein, "adjacent" means that two or more elements are in close enough proximity to allow an explosion in one element to be transmitted directly to other elements.

FIG. 1 moreover shows that the simultaneous linear initiation mechanism 100 can include one or more traces 108 in the second layer 106. The one or more traces 108 are channels within the second layer 106 configured to receive a high explosive. The traces 108 do not extend through the second layer 106 at all points. Starting from a single point, which is coincident with the port 104, the traces 108 are configured to receive high explosive and observe critical diameters required for the type of high explosive used.

FIG. 1 also shows that the simultaneous linear initiation mechanism 100 can include two or more destination points 110 in the second layer 106. The destination points 110 are the terminal ends of the traces 108. The distance from the initiation point to the destination points is equidistant for all destination points 110 (as used herein the term "equidistant" shall mean that the distances are within 10% of one another). Because the high explosive detonates at a consistent rate, equidistant traces ensure that the detonation propagates through the second layer 106 and reaches all destination points 110 at the same time. Thus, the second layer 106 has taken a single detonation at the initiation point and created multiple detonation points at the destination points 110.

FIG. 1 further shows that the simultaneous linear initiation mechanism 100 can include a third layer 112. The third layer 112 is a pass-through layer. That is, the third layer 112 includes multiple ports 114 configured to receive high explosive that pass the detonations from the destination points 110 and passes them on to a lower layer. By creating a pass through layer, the detonations in the second layer 106 from detonations in lower layers, ensuring that the detonation proceeds on a desired manner.

FIG. 1 additionally shows that the simultaneous linear initiation mechanism 100 can include one or more saddle blocks 116. The one or more saddle blocks 116 connect intimately to the main explosive. This spreads the detonation wave into a simultaneous wide line or lines of stimulation on the main high explosive surface. This can be shaped and form fitted to most any length or configuration of linear shaped charge. The saddle block 116 can be configured in such a way as to conduct the detonation so that it produces two simultaneous lines of detonation on the aft surface of the main high explosive in the shaped device. Other shapes and configurations of the saddle block 116 are implied here depending on the requirement of the charge to which it is being. Any length of initiation train can be accomplished with the simultaneous linear initiation mechanism system.

By having dual line simultaneous initiation higher jet velocities can be achieved from wider angle liners, similar to circumferential initiation in a conical charge, this facilitates shorter charges. By initiating the high explosive in two lines aligned with the collapse plane and some distance away from said plane, the angle of the detonation wave to the liner surface is decreased, causing the device to produce higher velocities and greater mass in the jet, thusly greater performance.

FIG. 1 moreover shows that the simultaneous linear initiation mechanism 100 can include one or more traces 118 in the saddle block 116. The one or more traces 118 are channels within the saddle block 116 configured to receive a high explosive. The traces 118 do not extend through the saddle block 116 at all points. Starting from a single point, which is coincident with the port 114, the traces 118 are configured to receive high explosive and observe critical diameters required for the type of high explosive used.

FIG. 1 also shows that the simultaneous linear initiation mechanism 100 can include multiple outlets 120. The multiple outlets 120 are adjacent the main high explosive. Thus, the detonation spreads from the multiple outlets 120 into the main high explosive in a linear manner. I.e., the main high explosive detonates along a line as stimulated by the multiple outlets 120.

FIG. 1 moreover shows that the simultaneous linear initiation mechanism 100 can include a linear liner 122. The linear liner shapes the explosion. That is, the detonation of the saddle block 116 occurs and the resultant explosion is shaped and directed by the linear liner. One of skill in the art will appreciate that the linear liner 122 is "linear" in that the explosion is directed straight away from the liner with a desired width. I.e., the explosion proceeds straight out from the linear liner 122. Thus, the linear liner 122 can be used to create any desired shape (e.g., a single line, spline, circular, rectangular, etc.).

One of skill in the art will appreciate that the number of layers can be changed depending on need. For example, the simultaneous linear initiation mechanism 100 can include a first layer 102, a second layer 106, a third layer 112, another second layer 106, another third layer 112 and a saddle 116. Thus any configuration of first layer 102-(second layer 106-third layer 112)$_n$-saddle block 116 can be used.

The layering system provides a number of benefits. For example, as noted above, the number of layers can be adjusted according to need. In addition, each layer can be separately produced before the exact needs are known. For example, a mining operation could have multiple configurations of each layer stored, and then determine, and quickly assemble, a simultaneous linear initiation mechanism 100 according to immediate need. Further, each layer can be stored isolated from other layers, preventing accidents. I.e., if an accidental detonation occurs anywhere in a preassembled initiation mechanism, the whole mechanism will detonate. However, with the simultaneous linear initiation mechanism 100 if a detonation occurs as little as a single layer may be detonated, reducing the size and severity of the resulting explosion. Moreover, the layering system lends itself to visual inspection. That is, each layer can be visibly inspected before use. In contrast a preassembled initiation mechanism can't be visually inspected. Therefore, if any damage has occurred (e.g., in transportation) then it can't be detected until the explosion doesn't occur as planned and costly measures are employed to inspect or destroy the preassembled initiation mechanism.

Figure 2:
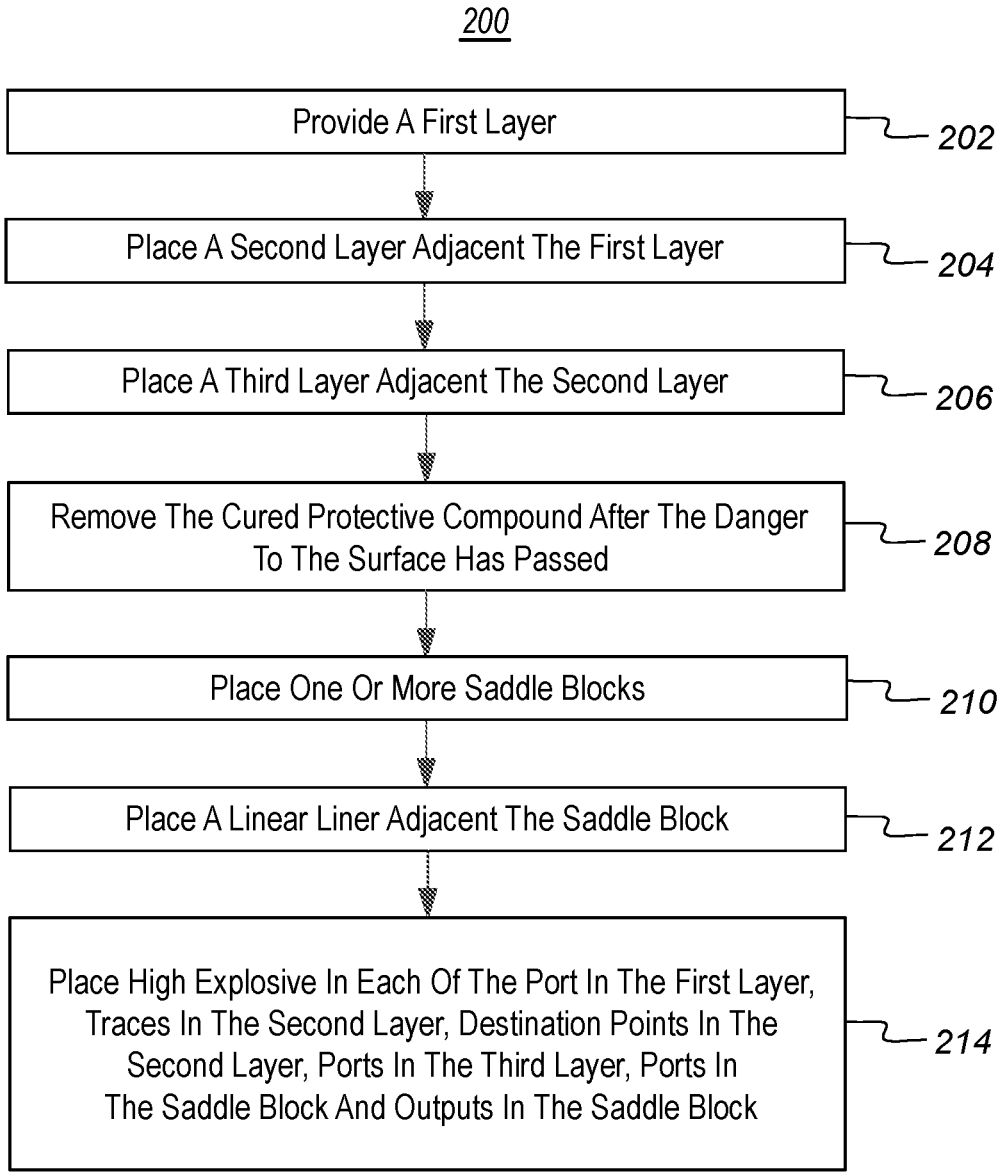
FIG. 2 is a flow chart illustrating a method of creating a simultaneous linear initiation mechanism.

FIG. 2 is a flow chart illustrating a method 200 of creating a simultaneous linear initiation mechanism. In at least one implementation, the simultaneous linear initiation mechanism can be the simultaneous linear initiation mechanism 100 of FIG. 1. Therefore, the method 200 will be described, exemplarily, with reference to the simultaneous linear initiation mechanism 100 of FIG. 1. Nevertheless, one of skill in the art can appreciate that the method 200 can be used to produce simultaneous linear initiation mechanisms other than the simultaneous linear initiation mechanism 100 of FIG. 1.

FIG. 2 shows that the method 200 can include providing 202 a first layer. The first layer is where the detonation begins. I.e., the first layer begins an explosive chain reaction which ends with a shaped detonation. The explosion can be initiated using conventional detonators of any desired type. The first layer is composed of a low sound speed material.

The first layer can include a port. The port is a hole which passes through the first layer and is configured to be filled with high explosive material. High explosives are explosive materials that detonate, meaning that the explosive shock front passes through the material at a supersonic speed. High explosives detonate with explosive velocity ranging from 3 to 9 km/s. For instance, TNT has a detonation (burn) rate of approximately 5.8 km/s (19,000 feet per second), Detonating cord of 6.7 km/s (22,000 feet per second), and C-4 about 8.5 km/s (29,000 feet per second). The term high explosive is in contrast with the term low explosive, which explodes (deflagrates) at a lower rate. Thus, the port is configured to allow the detonation of the high explosive to pass entirely through the first layer.

FIG. 2 also shows that the method 200 can include placing 204 a second layer adjacent the first layer. The second layer is placed adjacent the first layer. That is, portions of the second layer are in contact with the first layer. In particular, the port is placed adjacent the second layer such that the detonation of the high explosive in the port is transmitted directly to the second layer. The second layer is composed of a low sound speed material (which may be the same material as the first layer or a different material depending on the application). A low sound speed material contains the explosive and ensures that the detonation traverses the desired path (i.e., they are destroyed at a lower speed than the explosion propagates, acting as a path for the explosion).

The second layer can include one or more traces. The one or more traces are channels within the second layer configured to receive a high explosive. The traces do not extend through the second layer at all points. Starting from a single point, which is coincident with the port, the traces are configured to receive high explosive and observe critical diameters required for the type of high explosive used.

The second layer can also include two or more destination points. The destination points are the terminal ends of the traces. The distance from the initiation point to the destination points is equidistant for all destination points. Because the high explosive detonates at a consistent rate, equidistant traces ensure that the detonation propagates through the second layer and reaches all destination points at the same time. Thus, the second layer has taken a single detonation at the initiation point and created multiple detonation points at the destination points.

FIG. 2 further shows that the method 200 can include placing 206 a third layer adjacent the second layer. The third layer is a pass-through layer. That is, the third layer includes multiple ports configured to receive high explosive that pass the detonations from the destination points and passes them on to a lower layer. By creating a pass-through layer, the detonations in the second layer from detonations in lower layers, ensuring that the detonation proceeds on a desired manner.

FIG. 2 additionally shows that the method 200 can include placing 208 one or more saddle blocks. The one or more saddle blocks connect intimately to the main explosive. This spreads the detonation wave into a simultaneous wide line or lines of stimulation on the main high explosive surface. This can be shaped and form fitted to most any length or configuration of linear shaped charge. The saddle block can be configured in such a way as to conduct the detonation so that it produces two simultaneous lines of detonation on the aft surface of the main high explosive in the shaped device. Other shapes and configurations of the saddle block are implied here depending on the requirement of the charge to which it is being. Any length of initiation train can be accomplished with the simultaneous linear initiation mechanism system.

By having dual line simultaneous initiation higher jet velocities can be achieved from wider angle liners, similar to circumferential initiation in a conical charge, this facilitates shorter charges. By initiating the high explosive in two lines aligned with the collapse plane and some distance away from said plane, the angle of the detonation wave to the liner surface is decreased, causing the device to produce higher velocities and greater mass in the jet, thusly greater performance.

The simultaneous linear initiation mechanism can include one or more traces in the saddle block. The one or more traces are channels within the saddle block configured to receive a high explosive. The traces do not extend through the saddle block at all points. Starting from a single point, which is coincident with the port 104, the traces are configured to receive high explosive and observe critical diameters required for the type of high explosive used.

The simultaneous linear initiation mechanism can include multiple outlets. The multiple outlets are adjacent the main high explosive. Thus, the detonation spreads from the multiple outlets into the main high explosive in a linear manner. I.e., the main high explosive detonates along a line as stimulated by the multiple outlets.

FIG. 2 moreover shows that the method 200 can include placing 210 a linear liner adjacent the saddle block. The linear liner shapes the explosion. That is, the detonation of the saddle block occurs, and the resultant explosion is shaped and directed by the linear liner. One of skill in the art will appreciate that the linear liner is "linear" in that the explosion is directed straight away from the liner with a desired width. I.e., the explosion proceeds straight out from the linear liner. Thus, the linear liner can be used to create any desired shape (e.g., a single line, circular, rectangular, etc.).

FIG. 2 also shows that the method 200 can include placing 212 high explosive in each of the port in the first layer, traces in the second layer, destination points in the second layer, ports in the third layer, ports in the saddle block and outputs in the saddle block. One of skill in the art will appreciate that placing high explosive in each of the above-mentioned locations will allow the high explosive to be stored separately from the simultaneous linear initiation mechanism. Separate storage can reduce the amount to material which has to be stored with special handling and thus reduce cost.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A simultaneous linear initiation mechanism, the simultaneous linear initiation mechanism comprising: a first layer, wherein the first layer: includes a port, wherein the port: passes through the first layer; and is configured to receive a first high explosive; and the first layer is composed of a first low sound speed material; a second layer, wherein the second layer: includes: one or more traces, wherein the one or more traces include channels within the second layer configured to receive a second high explosive; and two or more destination points, wherein the two or more destination points are the terminal ends of the one or more traces; and the second layer is composed of a second low sound speed material; wherein a portion of each of the one or more traces in the second layer is adjacent the port in the first layer; and one or more saddle blocks, wherein the one or more saddle blocks: include: one or more traces, wherein the one or more traces include channels within the saddle block that are configured to receive a third high explosive; and multiple outlets, wherein the multiple outlets are configured to receive the third high explosive; and the one or more saddle blocks are each: configured to spread a detonation wave into a simultaneous shaped stimulation on a main high explosive surface wherein a main explosive is connected intimately to the multiple outlets; and the saddle blocks are composed of a third low sound speed material; and wherein each destination point in the second layer is adjacent a portion of one of the one or more traces in the saddle block.

2. The system of claim 1, wherein the first low sound speed material includes high density foam.

3. The system of claim 1, wherein the second low sound speed material includes high density foam.

4. The system of claim 1, wherein the first high explosive includes at least one of:

TNT; or

C-4.

5. The system of claim 1, wherein the shaped stimulation includes a linear stimulation.

6. The system of claim 1, wherein the shaped stimulation includes a spline stimulation.

7. The system of claim 1, wherein the shaped stimulation includes a window frame stimulation.

8. The system of claim 1, wherein the shaped stimulation includes a round stimulation.

9. The system of claim 1, wherein diameters of the one or more traces in the second layer are greater than or equal to a critical diameter required for the second high explosive.

10. The system of claim 1, wherein diameters of the one or more traces in the saddle block are greater than or equal to a critical diameter required for the third high explosive.

11. A simultaneous linear initiation mechanism, the simultaneous linear initiation mechanism comprising: a first layer, wherein the first layer: includes a port, wherein the port: passes through the first layer; and is configured to receive a first high explosive; and the first layer is composed of a first low sound speed material; a second layer, wherein the second layer: includes: one or more traces, wherein the one or more traces include channels within the second layer configured to receive a second high explosive; and two or more destination points, wherein the two or more destination points are the terminal ends of the one or more traces; and the second layer is composed of a second low sound speed material; wherein a portion of each of the one or more traces in the second layer is adjacent the port in the first layer; a third layer, wherein the third layer: includes two or more ports configured to receive a third high explosive; and the third layer is composed of a third low sound speed material; wherein each port in the third layer is adjacent at least one of the destination points in the second layer; one or more saddle blocks, wherein the one or more saddle blocks: include: one or more traces, wherein the one or more traces include channels within the saddle block that are configured to receive a fourth high explosive; and multiple outlets, wherein the multiple outlets are configured to receive the fourth high explosive; and are each: configured to spread a detonation wave into a simultaneous wide line of stimulation on a main high explosive surface wherein a main explosive is connected intimately to the multiple outlets; and the saddle blocks are composed of a fourth low sound speed material; and wherein each port in the third layer is adjacent a portion of one of the one or more traces in the saddle block.

12. The system of claim 11, wherein the destination points are all equidistant from the port in the first layer.

13. The system of claim 11, wherein the first low sound speed material is the same material as the second low sound speed material.

14. The system of claim 11, wherein the first low sound speed material is the same material as the third low sound speed material.

15. The system of claim 11, wherein the first low sound speed material is the same material as the fourth low sound speed material.

16. A simultaneous linear initiation mechanism, the simultaneous linear initiation mechanism comprising: a first layer, wherein the first layer: includes a port, wherein the port: passes through the first layer; and is filled with a first high explosive; and the first layer is composed of a first low sound speed material; a second layer, wherein the second layer: includes: one or more traces, wherein the one or more traces include channels within the second layer configured to receive a second high explosive; and two or more destination points, wherein the two or more destination points are the terminal ends of the one or more traces; and the second layer is composed of a second low sound speed material; wherein a portion of each of the one or more traces in the second layer is adjacent the port in the first layer; wherein the destination points are all equidistant from the port in the first layer; a third layer, wherein the third layer: includes two or more ports filled with a third high explosive; and the third layer is composed of a third low sound speed material; wherein each port in the third layer is adjacent at least one of the destination points in the second layer; and one or more saddle blocks, wherein the one or more saddle blocks: includes: one or more traces, wherein the one or more traces include channels within the saddle block that are filled with a fourth high explosive; and multiple outlets, wherein the multiple outlets are filled with the fourth high explosive; and the one or more saddle blocks are each: configured to spread a detonation wave into a simultaneous wide line of stimulation on a main high explosive surface wherein a main explosive is connected intimately to the multiple outlets; and the saddle blocks are composed of a fourth low sound speed material; and wherein each port in the third layer is adjacent a portion of one of the one or more traces in the saddle block; and a linear liner.

17. The system of claim 16, wherein the first and second high explosive are the same high explosive.

18. The system of claim 16, wherein the first and third high explosive are the same high explosive.

19. The system of claim 16, wherein the first and fourth high explosive are the same high explosive.

20. The system of claim 16, wherein the first high explosive and the main high explosive are the same high explosive.

* * * * *